US006059932A

United States Patent [19]

Sturgulewski

[11] Patent Number: 6,059,932

[45] Date of Patent: May 9, 2000

[54] COAL BED VIBRATION COMPACTOR FOR NON-RECOVERY COKE OVEN

[75] Inventor: Raymond M. Sturgulewski, Pittsburgh, Pa.

[73] Assignee: Pennsylvania Coke Technology, Inc., Greensburg, Pa.

[21] Appl. No.: 09/165,534

[22] Filed: Oct. 5, 1998

[51] Int. Cl.[7] ..... C10B 35/00; C10B 37/02

[52] U.S. Cl. ..... 202/262; 202/270; 202/117; 202/248; 201/40

[58] Field of Search ..... 202/117, 265, 202/262, 248, 270, 103, 239; 201/40, 5; 414/586, 587, 156, 157; 422/232; 110/101 CF; 193/35 TE; 198/533, 811, 801, 956

[56] References Cited

U.S. PATENT DOCUMENTS

| | | | |
|---|---|---|---|
| 2,676,915 | 4/1954 | Dupre | 202/262 |
| 3,515,293 | 6/1970 | Cain | 414/587 |
| 3,784,034 | 1/1974 | Thompson | 414/180 |
| 4,111,664 | 9/1978 | Leibrock | 44/530 |
| 4,186,054 | 1/1980 | Brayton et al. | 201/6 |
| 4,257,848 | 3/1981 | Brayton et al. | 202/82 |
| 4,375,388 | 3/1983 | Hara et al. | 202/239 |
| 4,491,505 | 1/1985 | Spindeler et al. | 202/270 |
| 4,681,597 | 7/1987 | Byrne et al. | 44/579 |
| 5,658,357 | 8/1997 | Liu et al. | 44/550 |

*Primary Examiner*—Marian C. Knode
*Assistant Examiner*—Susan Ohorodnik
*Attorney, Agent, or Firm*—Armstrong, Westerman Hattori, McLeland & Naughton

[57] ABSTRACT

A coal compaction system and method for a non-recovery coke oven having refractory roof, floor, side walls and end doors for coal charging and coke discharge provides an improved coal charging machine carrying a coal conveyor supported intermediate the ends of the conveyor to avoid conveyor sagging and non-uniform depth of a deposited coal bed, a number of pressurized fluid-driven vibratory compactors mounted on an end of the charging machine and spaced-apart across the width of the coal bed and serving to compact the coal bed on a retraction stroke of the charging machine, a pivoted lifting frame mounted on the charging machine above the compactors and from which the compactors individually are suspended and are provided with individual supply of pressurized fluid, and a coke pusher head mounted on the charging machine behind the compactors and serving, when the lifting frame and associated compactors are raised, to push finished coke from the coke oven.

9 Claims, 6 Drawing Sheets

COAL BED VIBRATION COMPACTOR FOR NON-RECOVERY COKE OVEN

BACKGROUND

1. Field of the Invention

This invention relates to means and methods for increasing coke quality and production capability of a non-by product recovery coke oven by compacting and thereby increasing the bulk density of a bed of coking coal introduced into the oven, and particularly to compaction of the coal by means of a vertically vibrating compactor attached to an end of a coal charging machine and is upwardly pivotable away from the compacted coal bed to allow finished coke to be pushed out of the coke oven.

2. Description of the Prior Art

An early type of coke oven was the so-called "bee hive" oven in which coal was coked without recovery of volatile by products ("non-recovery" coke ovens). By-product recovery coke ovens largely replaced early non-recovery ovens in order to recover the many valuable by-products of the coking process. However, improved designs of non-recovery coke ovens have seen a recent resurgence of interest and application of such ovens due to their low capital, operating and maintenance costs along with their ability to produce good quality coke.

A modern non-recovery coke oven is a refractory structure constructed of silica brick. It is used to convert coal into blast furnace grade coke by heating the coal in a reducing atmosphere (produced by off-gases and vapors from the coking process) and under a negative pressure (to reduce escape of evolved volatiles to the atmosphere). A recent non-recovery coke oven design, incorporating certain improvements by the present inventor, is shown in FIG. 1. After initial heating of the oven chamber, e.g. by a fuel-gas burner, a bed of coal is inserted into the oven through a removable oven charging door, e.g. by a coal charging machine. Such a machine of the prior art is shown in FIG. 2. It has several detriments. First, the conveyor is supported at one end adjacent the charging door and is cantilevered above the coal bed along the full length of the bed with the other end of the conveyor above the last portion of the bed to be deposited. With such construction, vertical deflection of the cantilevered conveyor results in a variation of the depth of the coal bed, with accompanying variation in heat transfer during coking and reduction of coke quality. Second, the coal falls from the conveyor only a small distance, e.g. about three feet, so that the deposited coal bed has a low bulk density.

Various means and methods have been developed in the prior art to increase the bulk density of coal beds introduced into coke ovens. For example, stamp charging of coal has long been used. In such technique, a plurality of drop hammers are caused to fall upon the top surface of the coal bed, thereby compacting the coal into a bed of increased density, which then is introduced into the coke oven. Stamp charging is exemplified in an article entitled *Planning and Operation of a Stamp Charged Coke Oven Plant with Tall Ovens,* by J. Echterhoff et al. describing a modern stamp charging facility installed at the Central Coke Oven Plant Saar, in the German Saar, in 1984.

U.S. Pat. Nos. 4,186,054 and 4,257,848 disclose compacting coal for coking by passing finely divided coal between opposed rotating rolls at a pressure of from about 20 to about 60 tons per linear inch.

In the non-coking area, it is known to pelletize finely divided coal for various uses of the carboniferous content, for example, as shown in U.S. Pat. No. 4,681,597. U.S. Pat. No. 5,658,357 describes the formation of coal "logs" by compacting coal fines with a binder in a mold or by extrusion to provide a safe and readily transportable form of coal, e.g. in an hydraulic pipeline.

SUMMARY OF THE INVENTION

According to the present invention, there is provided an improved charging machine, carrying a sled-supported, non-cantilevered coal conveyor movable into the coking chamber of a coke oven to deposit a coal bed of uniform depth on the coke oven floor, and then retractable out of the oven chamber while the coal bed is compressed. A leveling bar is attached to the charging machine in front of the conveyor, and the freshly deposited coal bed surface is contacted first by the leveling bar and then by an inclined edge of a compactor to provide a coal bed of uniform depth. Vertically movable, vibrating compactor means are mounted on an end of the charging machine facing the coke discharge door and comprise a plurality of compactor chambers, spaced apart and extending across the width of the coal bed deposited in the coke oven by means of which vibration energy is transmitted into the coal bed to compress the coal, e.g. by about 20%. A vibration piston/cylinder assembly in each compactor chamber is actuated by pressurized fluid, e.g. air, supplied through a flexible hose to the individual compactor chambers, thus assuring no mutual counteraction on actuation of the several piston/cylinder assemblies.

The conveyor also is adapted to push the finished coke out of the coke oven through a coke discharge door of the oven by attachment of a pusher head behind a coal discharge point of the conveyor, thus allowing the coke to be expelled from the oven on a forward stroke of the conveyor and coal to be charged and compacted on a retraction stroke of the conveyor. In order to accommodate such actions of the conveyor and the associated pusher head, the compactor means is upwardly pivotable to move it out of the way of the pusher head during discharge of the coke.

DESCRIPTION OF PREFERRED EMBODIMENTS

Figure 1:
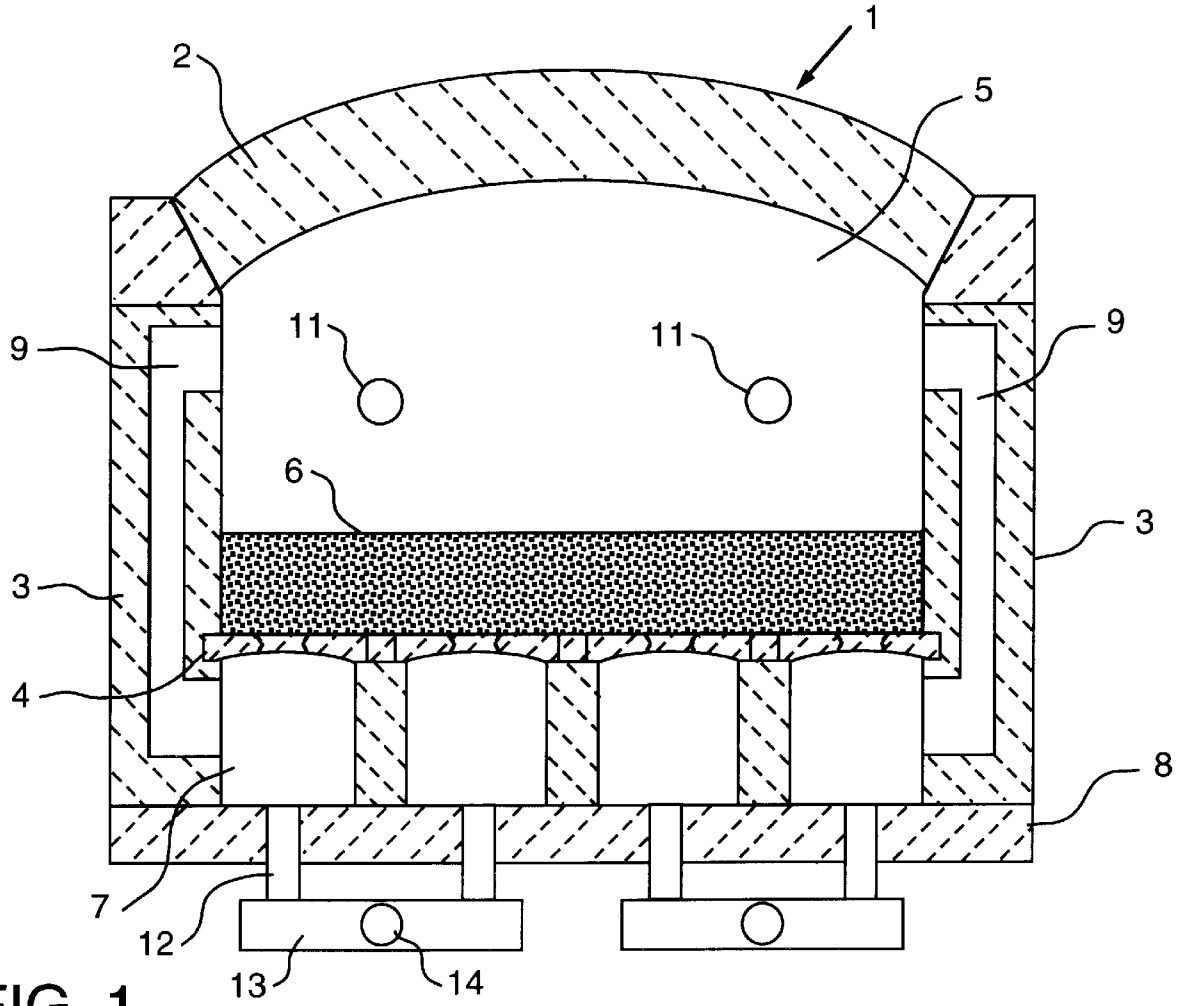
FIG. 1 is an end elevational, cross-sectional view of a non-recovery coke oven useful in the practice of the present invention.

In FIG. 1, the numeral 1 generally denotes a non-recovery coke oven of the type with which practice of the present invention is useful. The oven comprises an arch roof 2, two side walls 3 and a floor 4 forming an oven chamber 5. A coal bed 6 rests on the floor 4. Sole flues 7 are located beneath the floor 4, and a refractory and steel sub-structure 8 is provided for support of the oven. Coal is introduced into the oven chamber 5 through charging doors 21 and 22, and coke is removed from removable discharge end doors 10 having air dampers 15 therein for aiding in control of the amount of primary air introduced into the oven chamber (see FIG. 3). Within the side walls 3 are passages called "downcomers" 9 which transmit volatile combustibles from the free space in the oven chamber 5 above the coal bed to the sole flues 7 where they are burned to help heat the oven chamber 5. Primary air inlets 11 are provided in the coke oven end walls for admission of ambient air into the oven chamber, and further air inlets 12, extending through the sub-structure 8, provide secondary air to the flues 7 from manifolds 13 and supply pipes 14.

Initially, the oven refractory is heated, e.g. to about 2500° F., for example, by a fuel gas burner inserted temporarily into an opening (not shown) in an oven door. Thereafter the burner is removed when the desired oven refractory temperature has been reached. A bed of coal then is inserted into the oven through the charging doors, and the surface of the coal bed immediately generates combustible gases due to the radiant energy absorbed (primarily) from the oven roof. The heat generated by the primary combustion in the oven chamber 5, and by the secondary combustion in the sole flues 7, provides sufficient heat to convert the coal into coke. The proportion of primary and secondary air also helps to control the rate at which the thermal energy proceeds through the coal bed. Thus, two independent thermal gradients occur, one beginning at the top of the coal bed and progressing downward, and one beginning at the oven floor and progressing upward. It is desirable that the latter "sole flue" thermal gradient predominate because the coke, so heated, tends to be stronger and of higher quality, whereas the coke at the top of the bed resulting from the primary thermal gradient ("bee-hive" coke) contains more air pockets and may be somewhat spongy. Therefore, approximately ⅓ of the volatile combustibles are burned selectively in the oven chamber 5 by allowing primary air to be drawn in through the inlets 11 and with control of the amount of primary air by the dampers 15. The combustion products and the remaining ⅔ of the combustibles are drawn through the downcomers 9 into the sole flues 7 where secondary air is drawn, through inlets 12, into the flues to burn the remaining combustibles. Both the rate of heating of the coal bed and the quality of the coke are further improved by increasing coal bed bulk density and accompanying thermal transfer rate by means of the present invention.

Figure 2:
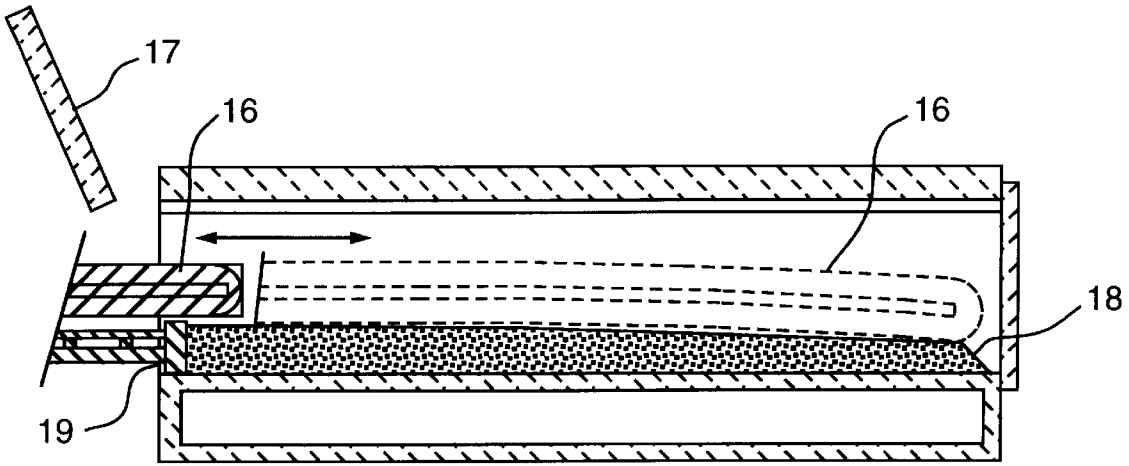
FIG. 2 Prior Art
FIG. 2 is a side elevational cross-section of a prior art coal charging conveyor.

In FIG. 2, the above-described prior art cantilevered coal conveyor is denoted by the numeral 16, in solid line in a retracted position at an upper left end oven door 17, as seen in FIG. 2, and in dotted line in an extended position over a deposited coal bed 18 of varying depth due to sagging of the cantilevered conveyor. A stationary false door 19 packs wet coal at this end of the oven. In such prior art facilities, the coal introduced into the oven contains a substantial amount of water, e.g. about 12%, to aid in packing the coal bed. Such water content adds to the necessary heat load of the oven, thus reducing coking efficiency.

Figure 3:
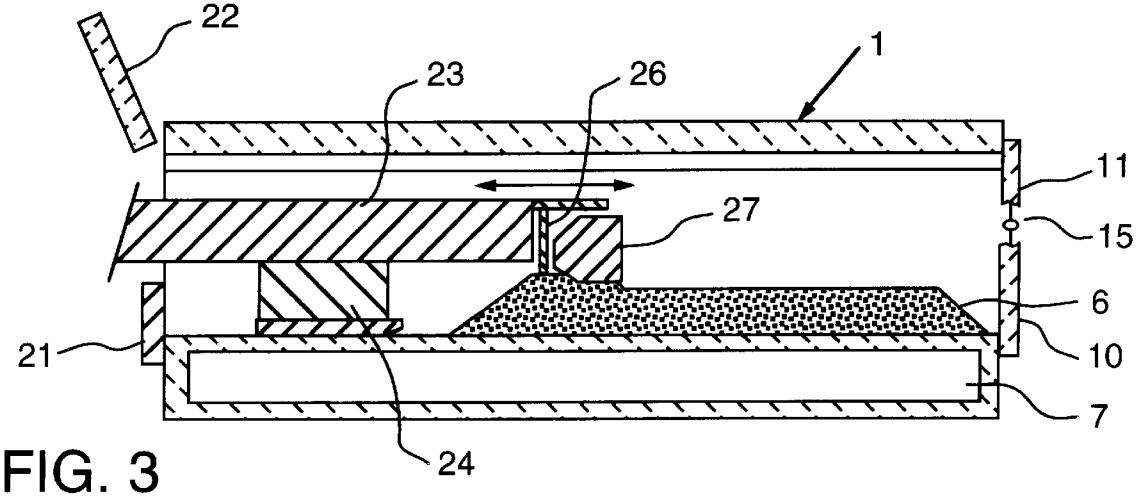
FIG. 3 is view, similar to that of FIG. 2, of the improved coal charging and compacting means of this invention.

In contrast, FIG. 3 illustrates one aspect of this invention constituting an improvement over the FIG. 2 prior art cantilevered coal charging conveyor. In the inventive design, the charging end of the coke oven 1 (left end as seen in FIG. 3) is provided with an upper, charging door 22 raisable by machine to permit entry of a coal charging machine 23 comprising a coal conveyor 43 mounted, approximately midway between the ends of the conveyor, on a sled support 24, and having a leveling bar 26 and a vibrating compactor, denoted generally by the numeral 27, mounted at an inner end of the conveyor (i.e the end facing the coke discharge door).

Figure 4:
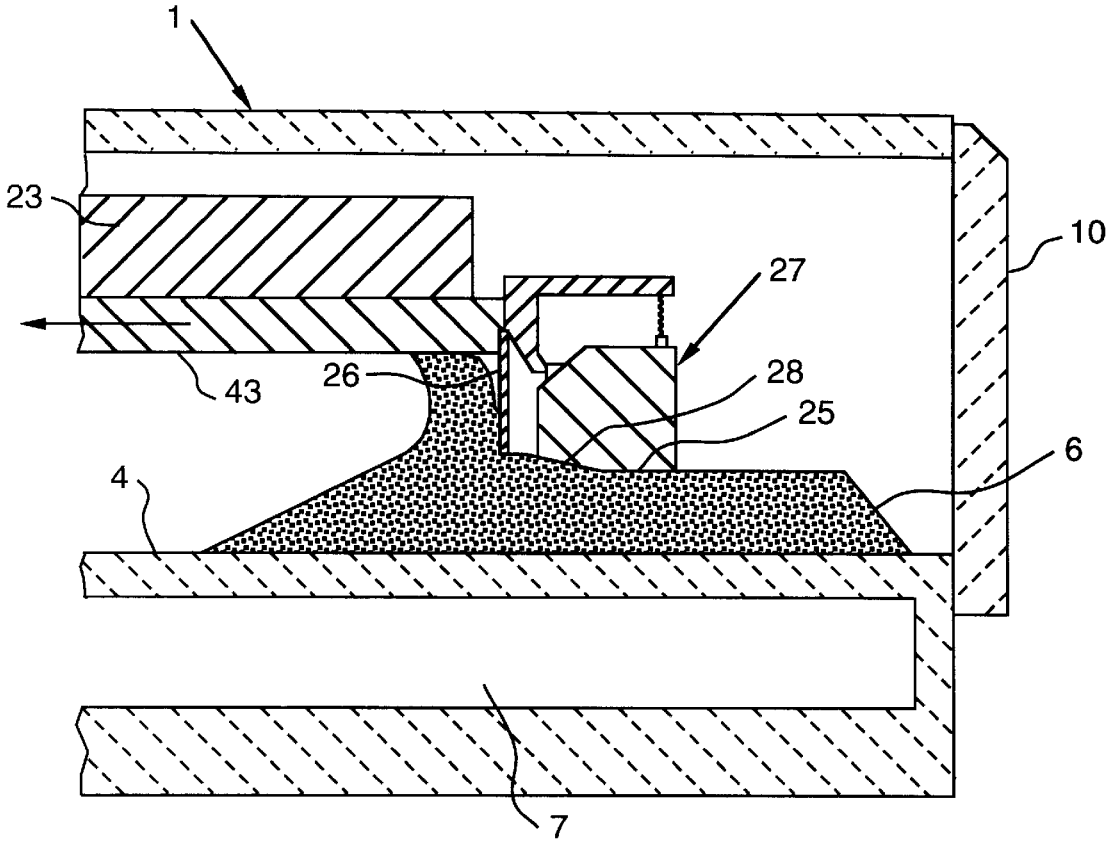
FIG. 4 is a side elevational cross-section of a portion of a non-recovery coke oven, showing formation of a coal bed in accordance with the present invention.

As more clearly seen in FIG. 4, as coal is discharged from the charging conveyor as it is retracted toward the charging door, the leveling bar 26 strikes off an even horizontal surface of the coal bed 6 the uniform depth of which is facilitated by the supported conveyor which does not sag as in the case of the prior art cantilevered conveyors. Following such bed-leveling action, an inclined surface 28 of the compactor 27 contacts the freshly deposited top surface of the coal bed 6 to provide a smooth transition from entry coal to packed coal. Thereafter, a flat, horizontal surface 25 of the compactor 27 contacts the coal bed in a vertically vibrating motion to compress the bed, e.g. by about 20%, to a reduced thickness corresponding in area to that of the horizontal surface 29 of the compactor 27.

Figure 5A:
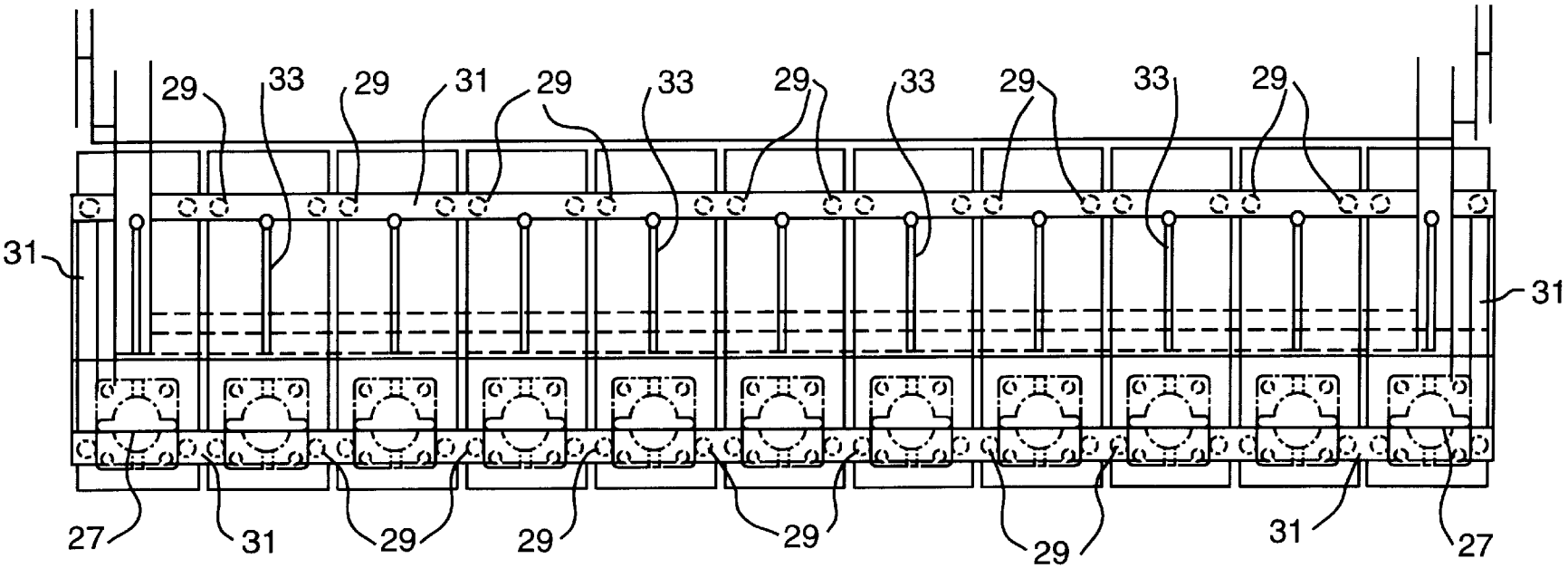
FIG. 5A is a top plan view of a non-recovery coke oven embodying the coal compacting means of this invention.
Figure 5B:
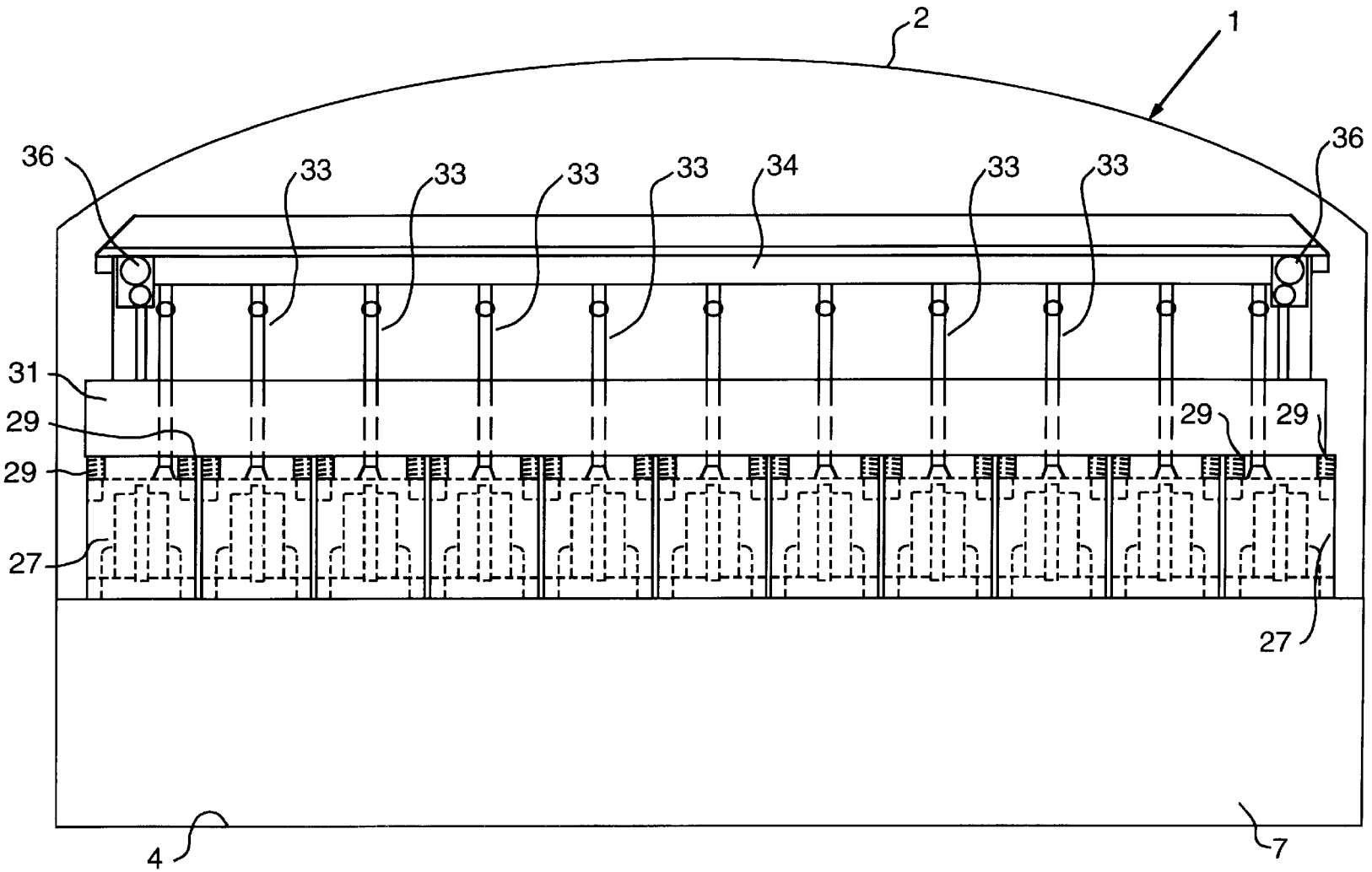
FIG. 5B is a front elevational view of a non-recovery coke oven embodying the coal compacting means of this invention.

As shown in FIGS. 5A and 5B, the compactor means 27 comprises a plurality of individual compactor chambers (11 such elements being shown in FIGS. 5A and 5B) are juxtaposed across the width of the coke oven chamber, so that substantially the entire coal bed is so compressed.

It has been found that, if all of the compactor chambers are not isolated from each other, they interfere with each other and try to compensate for the effect of the other vibrating compactor chambers. Accordingly, as shown in FIGS. 5A and 5B, and in more detail in FIGS. 6A–6D, each charging machine is provided with a single lifting frame 31 to which are attached a plurality of spring hangers 29 from which the compactor chambers 27 are independently suspended. The compactor chambers 27 are connected to each other by structural beams 30 which are mounted on the lifting frame 31 (FIG. 6B) and which form, with the lifting frame, an assembly for collectively moving the compactor chambers toward and away from the coal bed. Each compactor chamber is provided with a single, e.g. 4 inch, e.g. pneumatic, impact-type piston/cylinder vibrator assembly 32 connected by a flexible, heat-resistant, e.g. stainless steel, hose 33 supplied with pressurized fluid, e.g. air, from a fluid header 34 connected to a fluid source pipe 36 pressurized, for example, by a compressor (not shown). The compressed fluid, moving through internal fluid ports in opposite ends of the assembly cylinder, moves the piston up and down against the surface of the coal bed to compress the coal. Such independent mounting of, and independent pressurized fluid supply to, the compactor chambers is important to assure that the vibrator assemblies 32 do not counteract each other, with resulting reduced and uneven compression of the coal bed.

Figure 6A:
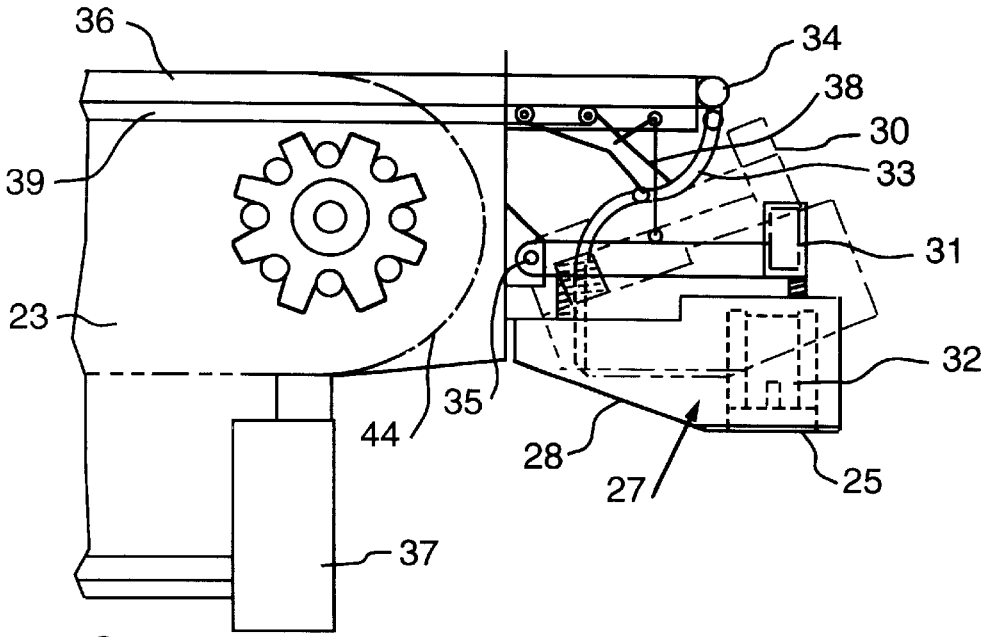
FIG. 6A is a side elevational sketch of a portion of the compacting means of the invention, including a pivotable lifting frame from which the vibrating compactor chambers are suspended and shown in lowered position (solid line) and in a raised position (dotted line)

As further seen in FIG. 6A, the coal charging machine/conveyor also can serve to push the finished coke out of the coke oven. Thus the charging machine 23 is provided with a pusher head 37 disposed behind the coal discharge point of the conveyor. This allows the coke to be expelled from the discharge end of the oven chamber on a forward stroke of the charging machine (toward the discharge end of the oven—on the right as seen in FIGS. 3, 4 and 6A) and coal to be charged and compacted on a retraction stroke (toward the charging end of the oven—on the left as seen in FIGS. 3, 4 and 6A).

As shown in FIG. 3, the coke oven 1 may have a raisable lower door 21 to confine coal, particularly dry coal, during charging. In the case of low to moderate water content of the coal charge, e.g. about 8%, door 21 may be eliminated and the pusher head 37 (FIG. 6A) used to contain the charged coal. In such case, when charging is nearly completed and the charging machine is nearly out of the oven, the direction of motion of the charging machine is reversed to move forward a few feet against the coal bed to compact a near vertical wall of moist coal which remains substantially vertical when the motion of the charging machine again is reversed and the machine is retracted from the oven.

Use of the above-described invention allows the water content of the charged coal to be reduced to about 6–8%, thereby reducing the necessary heat load and increasing coking efficiency. Achievement of this action requires that each of the compactor chambers 27, attached to the lifting frame 31 and connected by the structural beams 30 mounted on the lifting frame, be rotated upwardly by the lifting frame/beam assembly so that the compactors will be above the coke bed during pushing and thus out of the way of the pusher head 37. This is accomplished by an articulated linkage 38 (FIG. 6A), located above the lifting frame/beam assembly, which upwardly pivots about pivot point 35 on the lifting frame 31 (FIGS. 6A and 6B) upon actuation of the linkage, e.g. by an actuation bar 39 attached to the charging machine conveyor frame 44 (FIG. 6A). Bar 39 is actuated on a timed schedule, e.g. by means of a preset programmable logic controller (PLC—not shown) to actuate the articulated linkage 38 before pushing the finished coke. When coke pushing is completed, the PLC returns the actuating mechanism to again lower the lifting frame/beam assembly and associated compactor chambers 27.

Figure 6B:
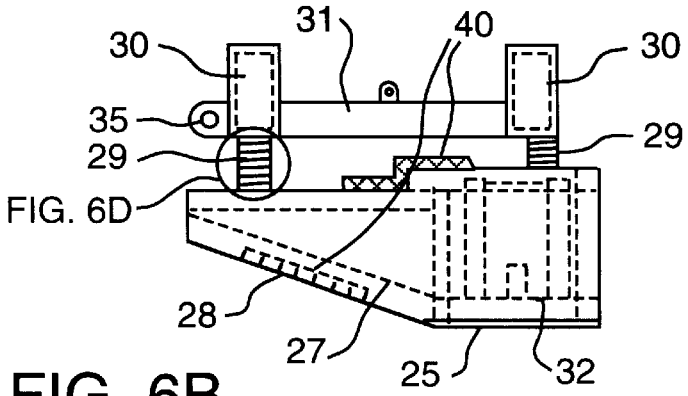
FIG. 6B is a side elevational sketch of a compactor chamber.
Figure 6C:
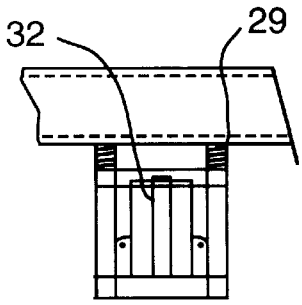
FIG. 6C is a side elevation of a compactor chamber vibrator.
Figure 6D:
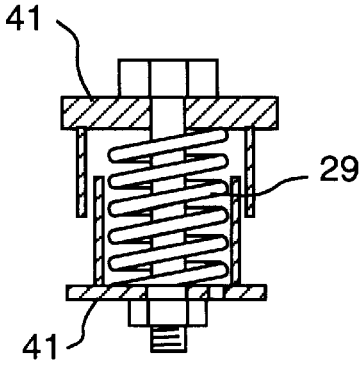
FIG. 6D is a side elevation of a portion, as indicated by the circle, of the vibrator means of FIG. 6C.

Due to the high temperature encountered by the coal charging and compacting means while inside the oven chamber during coal charging and compaction, it is necessary to provide such mechanism with adequate heat protection. In FIG. 6B, there is shown areas of insulation 40 to protect the compactor chambers 27. As shown in FIG. 6D, each spring hanger 29, from which the compactor chambers are suspended, has thermal shields 41 protecting spring elements 42 from overheating with consequent loss of resiliency and damping action vis-a-vis other compactors suspended from other hangers.

The invention as above described provides a non-recovery coking process and facility of highly competitive installation, operation and maintenance costs and efficiency as compared to other non-coking facilities, and produces low cost, enhanced quality, blast furnace grade coke.

What is claimed is:

1. A non-cantilevered coal bed vibration compactor system for a non-recovery coke oven, the non-recovery coke oven having a coking chamber formed by a refractory roof, floor, side walls; a coal charging door; and a coke discharge door on opposite ends of the non-recovery coke oven; said non-cantilevered coal bed vibration compactor system comprising:

a sled support movable into and out of the coking chamber through the charging door, a non-cantilevered coal charging machine having two ends and mounted therebetween on the sled support and the non-cantilevered coal charging machine further comprising, a non-cantilevered coal conveyor frame carrying a coal conveyor, the coal conveyor mounted on the charging machine with the sled support disposed intermediate the ends of the coal conveyor and, on a retraction stroke of the charging machine, the coal conveyor deposits coal, through a coal discharge point proximate the end of the coal charging machine facing the coke discharge door, in a substantially uniform depth upon the coking chamber floor to form a bed of coal to be coked, and a vibration compactor means mounted on the end of the coal charging machine facing the coke discharge door in front of the conveyor coal discharging point and for densifying the coal bed to a uniform depth during the retraction stroke of the coal charging machine which, by the non-cantilevered structure, does not sag, thereby enhancing heat transfer by forming a coal bed of uniform depth and enhancing coke quality by reducing air pockets in the coal bed producing spongy coke.

2. A system according to claim 1, wherein the vibration compactor means comprises a plurality of individual compactor chambers spaced apart across the width of the coke oven chamber and adjacent each other so that substantially the entire coal bed is compressed during the retraction stroke of the charging machine.

3. A system according to claim 2, wherein each compactor chamber comprises a vibrator including a pressurized fluid-actuated piston/cylinder assembly, a flexible heat-resistant hose connected, at one end, to a source of pressurized fluid and, at the other end, to the piston/cylinder assembly, whereby, upon introduction of pressurized fluid into opposite ends of the piston/cylinder assembly, the piston of the piston/cylinder assembly drives a corresponding compactor chamber vertically into and out of compressing contact with the coal bed.

4. A system according to claim 3, wherein each compactor chamber has an inclined surface facing toward the coal charging door and adapted, on the retraction stroke of the charging machine, to contact a top surface of a freshly deposited coal bed to provide a smooth transition from entry coal to packed coal in the coal bed, and a horizontal bottom surface adapted, on actuation of the vibrator, repeatedly to vertically contact and densify the coal bed.

5. A system according to claim 4, further comprising a generally rectangular lifting frame mounted on the charging machine and extending substantially across the width of the coking chamber, and a plurality of spaced-apart spring hangers attached to the lifting frame and wherein each compactor chamber is individually suspended from corresponding spring hangers to isolate the individual compactor chamber vibrators and, with the connection of the individual vibrators to a pressurized fluid supply source, to avoid their counteracting each other with resulting reduced and uneven compression of the coal bed.

6. A system according to claim 5, wherein one end of the lifting frame is pivoted for upward pivoting movement and the system further comprises an articulated linkage disposed above and connected to the lifting frame, lifting frame actuator means attached to the coal conveyor frame and adapted, on operation of the actuator means, to pivot the lifting frame and associated compactor chambers upwardly above the compressed coal bed.

7. A system according to claim 6, further comprising a plurality of structural beams mounted on the lifting frame, connecting the individual compactor chambers and, with the lifting frame, forming an assembly for simultaneously lifting all compactor chambers on upward pivoting of the lifting frame.

8. A system according to claim 7, further comprising a pusher head mounted on the charging machine facing the coke discharge door and behind a coal discharge point of the conveyor and adapted, upon upward pivoting of the lifting frame, to push finished coke through the coke discharge door of the coke oven.

9. A system according to claim 5, further comprising a heat shield surrounding each spring hanger to protect the spring hanger from heat in the coke oven chamber during coal charging and compacting.

* * * * *